US010584476B2

(12) United States Patent
Morgan

(10) Patent No.: US 10,584,476 B2
(45) Date of Patent: Mar. 10, 2020

(54) FRAMEWORK MODULE FOR USE IN MODULAR BUILDING CONSTRUCTION

(71) Applicant: David Ryan Morgan, Perth (AU)

(72) Inventor: David Ryan Morgan, Perth (AU)

( * ) Notice: Subject to any disclaimer, the term of this patent is extended or adjusted under 35 U.S.C. 154(b) by 0 days.

(21) Appl. No.: 15/998,232

(22) Filed: Sep. 14, 2016

(65) Prior Publication Data

US 2019/0226198 A1 Jul. 25, 2019
US 2019/0338507 A9 Nov. 7, 2019

(30) Foreign Application Priority Data

Nov. 13, 2015 (AU) ..... 2015904689

(51) Int. Cl.
*E04B 1/19* (2006.01)
*E04B 1/348* (2006.01)
*E04B 1/343* (2006.01)

(52) U.S. Cl.
CPC ..... *E04B 1/1903* (2013.01); *E04B 1/1912* (2013.01); *E04B 1/3483* (2013.01); *E04B 1/34326* (2013.01); *E04B 1/34331* (2013.01); *E04B 2001/1957* (2013.01); *E04B 2001/1978* (2013.01)

(58) Field of Classification Search
CPC ..... E04B 1/1903; E04B 1/1912; E04B 2001/1978; E04B 2001/1957
See application file for complete search history.

(56) References Cited

U.S. PATENT DOCUMENTS 3,000,602 A * 9/1961 O'Brien ..... B65D 19/12 108/14
3,877,091 A * 4/1975 Jureit ..... A47C 23/05 403/231
4,335,558 A * 6/1982 Caldwell ..... E04B 1/24 52/13
4,501,033 A * 2/1985 Kessel ..... A47C 19/021 403/117
4,577,449 A * 3/1986 Celli ..... E04B 1/2403 182/186.8
5,289,665 A * 3/1994 Higgins ..... E04B 1/2403 211/191
6,032,431 A * 3/2000 Sugiyama ..... E04B 1/2604 52/656.9
6,234,330 B1 * 5/2001 Gray ..... A47F 5/0838 211/103
6,474,902 B1 * 11/2002 Beauvoir ..... E04B 1/2403 403/403
7,310,920 B2 * 12/2007 Hovey, Jr. ..... E04B 1/24 52/282.1

(Continued)

*Primary Examiner* — Joshua K Ihezie
(74) *Attorney, Agent, or Firm* — Eric L. Lane; Green Patent Law

(57) ABSTRACT

A framework module for use in modular building construction comprises a plurality of elongate upright and cross beams, rigidly connected at or towards their ends to form a box frame with open side and end faces, and; at least one connection point on each of the upright beams which is configured to allow mutual connection with an equivalent connection point located on a substantially identical adjacent framework module, so that a plurality of framework modules can be connected together to form an open-web truss of vertically and horizontally aligned members.

15 Claims, 11 Drawing Sheets

(56) References Cited

U.S. PATENT DOCUMENTS

| | | | | |
|---|---|---|---|---|
| 8,627,632 | B2 * | 1/2014 | Werner | F16B 9/02 52/648.1 |
| 9,145,671 | B1 * | 9/2015 | Cornell | E04H 1/005 |
| 2003/0152421 | A1 * | 8/2003 | Lu | A47B 13/02 403/188 |
| 2004/0107651 | A1 * | 6/2004 | Johnson | E04B 1/3483 52/6 |
| 2007/0186503 | A1 * | 8/2007 | Homma | E04B 1/2604 52/655.1 |
| 2008/0047184 | A1 * | 2/2008 | Dean | G09F 15/0012 40/624 |
| 2009/0223425 | A1 * | 9/2009 | Randall | A47B 9/14 108/147.19 |
| 2010/0043329 | A1 * | 2/2010 | Dagg | E04B 1/24 52/414 |
| 2011/0179741 | A1 * | 7/2011 | Yen | E04B 1/34326 52/653.1 |
| 2012/0304549 | A1 * | 12/2012 | Rutledge | E04B 1/34315 52/16 |
| 2018/0055229 | A1 * | 3/2018 | Game | A47B 21/02 |
| 2018/0127969 | A1 * | 5/2018 | Acquistapace | E04B 1/26 |

* cited by examiner

FRAMEWORK MODULE FOR USE IN MODULAR BUILDING CONSTRUCTION

FIELD

The present invention relates to a framework module for use in modular building construction. More particularly, the present invention relates to a rigid box framework that forms a module for use in modular building construction.

BACKGROUND

Steel framing is a building technique that uses interconnected vertical and horizontal members to form a skeleton framework for a building. Once the framework has been constructed, the floors, roof and walls of the building are attached to and supported by the frame. This type of building technique is in common use. As well as vertical and horizontal members, a steel box frame typically requires diagonal bracing between the horizontal and vertical members in a number of key locations to provide structural stiffness. It can be difficult to use this type of construction method for modular construction, as the requirement for diagonal bracing can place significant limits on the number of different ways that the individual modules can be assembled.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY

It is an object of the present invention to provide a framework module for use in modular building construction which goes some way to overcoming the abovementioned disadvantages or which at least provides the public or industry with a useful choice.

The term "comprising" as used in this specification and indicative independent claims means "consisting at least in part of". When interpreting each statement in this specification and indicative independent claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

Accordingly, in a first aspect the present invention may broadly be said to consist of a framework module for use in modular building construction, comprising: a plurality of elongate upright and cross beams, rigidly connected at or towards their ends to form a box frame with open side and end faces; at least one connection point on each of the upright beams, configured to allow mutual connection with an equivalent connection point located on a substantially identical adjacent framework module so that a plurality of framework modules can be connected together to form an open-web truss of vertically and horizontally aligned members.

Preferably the box frame and connection points are configured to have both vertical and horizontal axes of symmetry around the external planes of a box defined by a 2 meter by 2 meter by 3 meter volume within which the framework module is located.

Preferably the framework module for use in modular building construction further comprises at least one connection point on each of the cross beams.

Preferably the upright beams have a length of substantially 2.9 metres, and the cross beams have a length of substantially 1.7 metres.

Preferably each of the connection points is formed from a length of tube connected to an outwardly-facing portion of a beam.

Preferably the connection points are connected in parallel with the axis of the beam.

Preferably each of the upright and cross beams are formed from hollow tubes with a substantially square cross section.

Preferably the upright and cross beams are formed from 100 mm×100 mm SHS mild steel tube.

Preferably the connection points are located towards the inner side or edge of the beam.

Preferably each of the uprights and each of the cross beams further comprises a mutual connection means, configured to allow a plurality of cross beams to be connected to an upright substantially at the ends of the upright, perpendicular to the upright and to each other.

Preferably the mutual connection means comprises a plurality of upright brackets, connected to each of the uprights at or close to the ends, the brackets configured for connection to the cross beams.

Preferably the framework module for use in modular building construction further comprises a plurality of cross beam brackets connected to each of the cross beams at or close to the ends of the cross beams and configured to allow connection with the upright brackets.

Preferably the cross beam brackets are further configured to allow connection with adjacent cross beam brackets on an adjacent cross beam.

Preferably the upright brackets are configured to fit within and slide into an open end of the cross beams to allow connection.

Preferably each of the upright brackets comprises a right-angle bracket, at least one pair of brackets connected to the upright substantially at one end on adjacent faces of the upright, the upright brackets aligned in parallel with the axis of the upright.

Preferably the framework module for use in modular building construction further comprises a pair of brackets substantially at each end, on the same adjacent faces as the pair at the other end, all of the upright brackets aligned in parallel with the axis of the upright.

Preferably each of the cross beam brackets comprises a right-angle bracket, at least one pair of cross beam brackets connected to the upright substantially at opposite ends on one face of the cross beam, the cross beam brackets aligned perpendicular to the axis of the cross beam.

Preferably each of the upright brackets comprises a plurality of bolt holes passing through the face of the bracket aligned towards the other one of the pair at that end, and each one of the cross beam brackets comprises a plurality of bolt holes passing through the face of the bracket aligned towards the other one of the pair at the opposite end of the cross beam.

Preferably each one of the cross beam brackets further comprises a pair of notches at each end of the other face of the cross beam bracket.

Preferably each of the connection points has a length of substantially 200 mm.

Preferably each of the upright beams comprises a substantially centrally located connection point and an upper and a lower connection point spaced so that their mid-points are substantially 1000 mm from the mid-point of the centrally located connection point.

Preferably each of the cross beams comprises a pair of connection points each located with their mid-point substantially 500 mm from the centre of the cross beam.

Preferably each of the connection points is formed from a 40 mm×40 mm tube.

Preferably each of the connection points is formed from SHS mild steel.

In a second aspect, the invention may broadly be said to consist in a framework member for use in modular building construction, comprising: an elongate beam formed from a hollow tube with a substantially square or rectangular cross section; a mutual connection means at or towards at least one end and on at least one face of the beam, configured to allow connection of the elongate beam to a separate and similar elongate beam so that the beams extend perpendicular to one another once connected; at least one connection point on an outer surface of the beam partway along the axis of the beam.

Preferably the connection means comprises at least one bracket, connected to the beam at or close to the end and configured to fit within and slide into an open end of a separate similar beam to allow connection.

Preferably each of the upright brackets comprises a right-angle bracket.

Preferably at least one pair of brackets is connected to the beam substantially at one end on adjacent faces of the beam, the brackets aligned in parallel with the axis of the beam.

Preferably the framework member further comprises a pair of brackets substantially at each end of the beam, on the same adjacent faces as the pair at the other end, all of the brackets aligned in parallel with the axis of the beam.

Preferably each of the brackets comprises a plurality of bolt holes passing through the face of the bracket aligned towards the other one of the pair at that end.

Preferably the framework member has an overall length of substantially 2.9 metres.

Preferably a pair of brackets are connected to the same face of the elongate beam at opposed ends of the beam, the brackets aligned perpendicular to the axis of the beam.

Preferably each of the brackets comprises a plurality of bolt holes passing through the face of the bracket aligned towards the other one of the pair at the opposite end of the cross beam.

Preferably each one of the brackets further comprises a pair of notches at each end of the other face of bracket.

Preferably the beam has a length of substantially 1.7 metres.

Preferably each connection point is formed from a length of tube connected to an outwardly-facing portion of a beam Preferably each connection point is connected in parallel with the axis of the beam.

Preferably each of the connection points has a length of substantially 200 mm.

Preferably each connection point is located towards an edge of the beam.

In a third aspect, the invention may broadly be said to consist in a building, comprising a plurality of framework modules as claimed in any one of the statements above.

In a fourth aspect, the invention may broadly be said to consist in a method of constructing a building using a plurality of framework modules as claimed in any one of the statements above, comprising the steps of:

(i) emplacing the framework modules next to and on top of one another as required in order to form an open-web truss of vertically and horizontally aligned members, and so that connection points on adjacent framework modules are directly adjacent;

(ii) connecting the framework modules to one another via the directly adjacent connection points.

With respect to the above description then, it is to be realised that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE FIGURES

Further aspects of the invention will become apparent from the following description which is given by way of example only and with reference to the accompanying drawings which show an embodiment of the device by way of example, and in which:

FIG. 5*a* shows a perspective view from above and to one side of the end of an upright beam according to a second embodiment of the invention, having right-angle brackets connected on two adjacent sides, the brackets aligned with the axis of the upright having bolt holes on their outer faces, larger apertures in the faces of the upright inside the perimeter of the brackets allowing the head of a bolt to pass through.

DETAILED DESCRIPTION

Embodiments of the invention, and variations thereof, will now be described in detail with reference to the figures.

Figure 4:
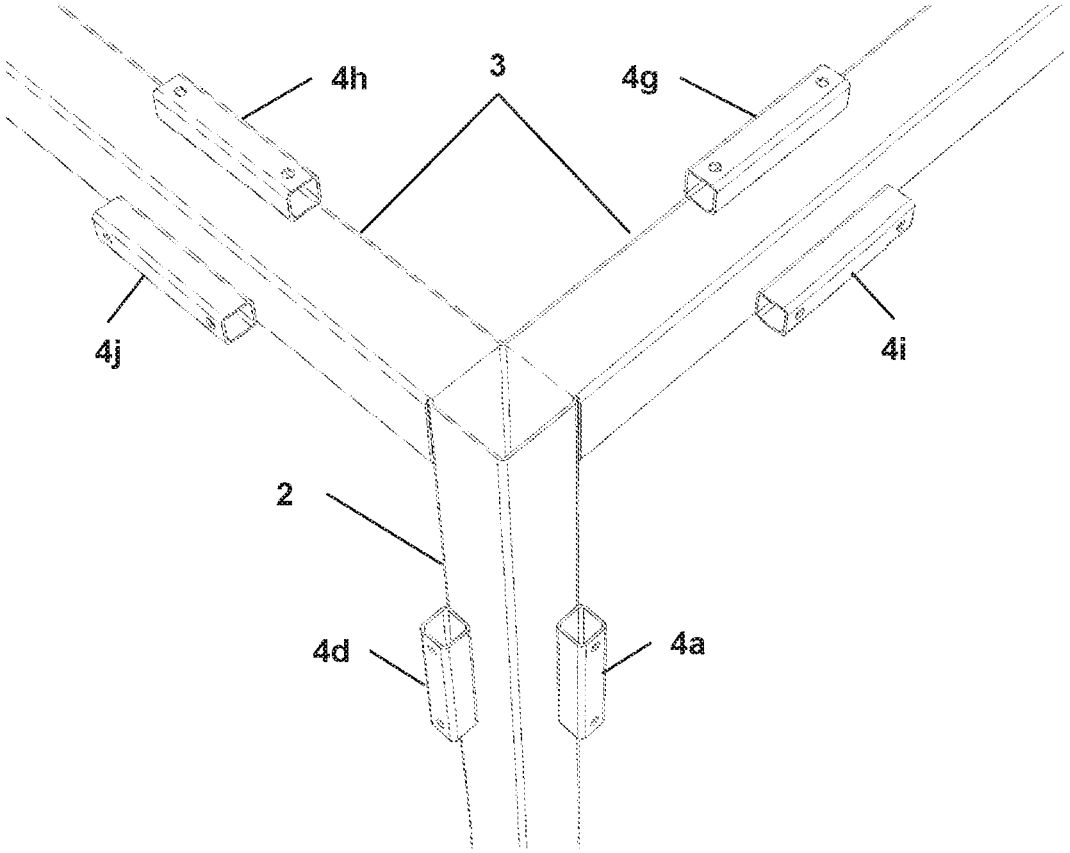
FIG. 4 shows close-up detail of a corner of the framework module of the preceding figures showing the connection pattern of the upright and cross beams, and detail of the connection of two of the connection points to the upright beam.

A first embodiment of a framework module 1 is shown in FIGS. 1 to 4. The framework module 1 has the overall shape and form of a rectangular box frame, with open sides and open end faces. The box frame that forms the main part of the framework module 1 is constructed from elongate beams, that form the uprights 2 and cross beams 3 of the framework module 1, and which are connected at their ends by welding as shown in FIG. 4. Each of the elongate beams 2, 3 is formed from 100 mm×100 mm SHS (Square Hollow Section) mild steel tube. The beams that form the upright beams 2 (vertically aligned in use) have a length of 2900 mm. The beams that form the cross beams 3 (horizontally aligned and forming the perimeter of a square in use) have a length of 1700 mm. The connection pattern for the beams 2, 3 where they meet at the corners of the framework module 1 is shown in FIG. 4.

Connection points 4 are attached to or formed on the upright and cross beams 2, 3, on the outwardly-facing surfaces of the upright and cross beams 2, 3. The connection points 4 are not point elements, but are formed from 200 mm lengths of 40 mm×40 mm SHS mild steel tube. The connection points 4 are welded to the upright and cross beams 2, 3 with their long axis in parallel with the axis of the beam 2 or 3 to which they are connected. The connection points 4 are connected or attached so that they are aligned with the inside edge face of the beam to which they are attached. That is, so that the inner side face of the connection point 4 is directly adjacent to the edge of the open rectangle or square formed by the beams 2, 3, on any given side of the framework module 1.

Figure 1:
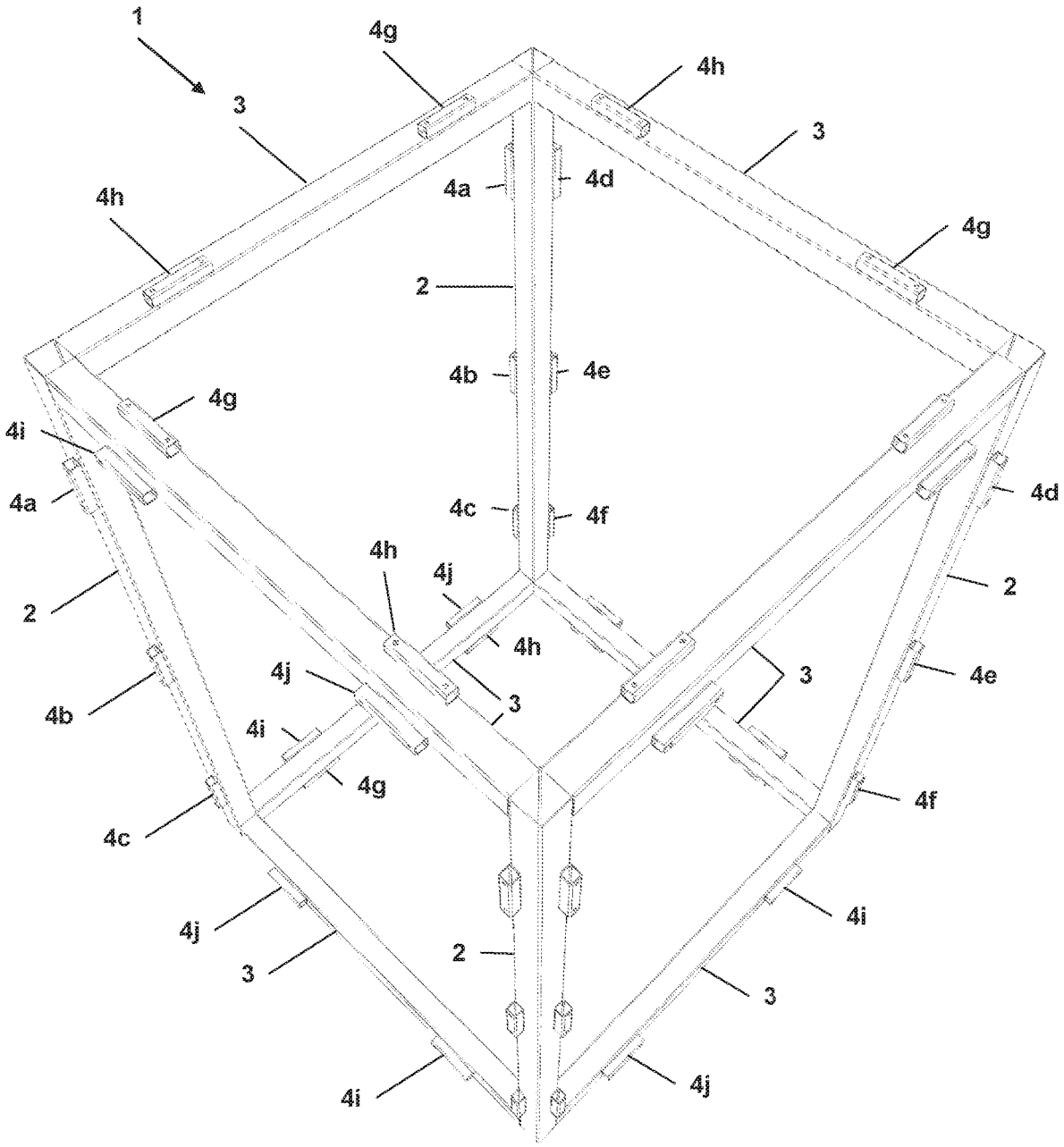
FIG. 1 shows a perspective view from above and to one side of a framework module according to an embodiment of the invention, showing detail of the elongate upright and cross beams that form the framework module, and which are rigidly connected at their ends to form a box frame with open side and end faces, the figure also showing connection points located on each of the upright beams that allow mutual connection with equivalent connection points located on a substantially identical adjacent framework module.
Figure 2A:
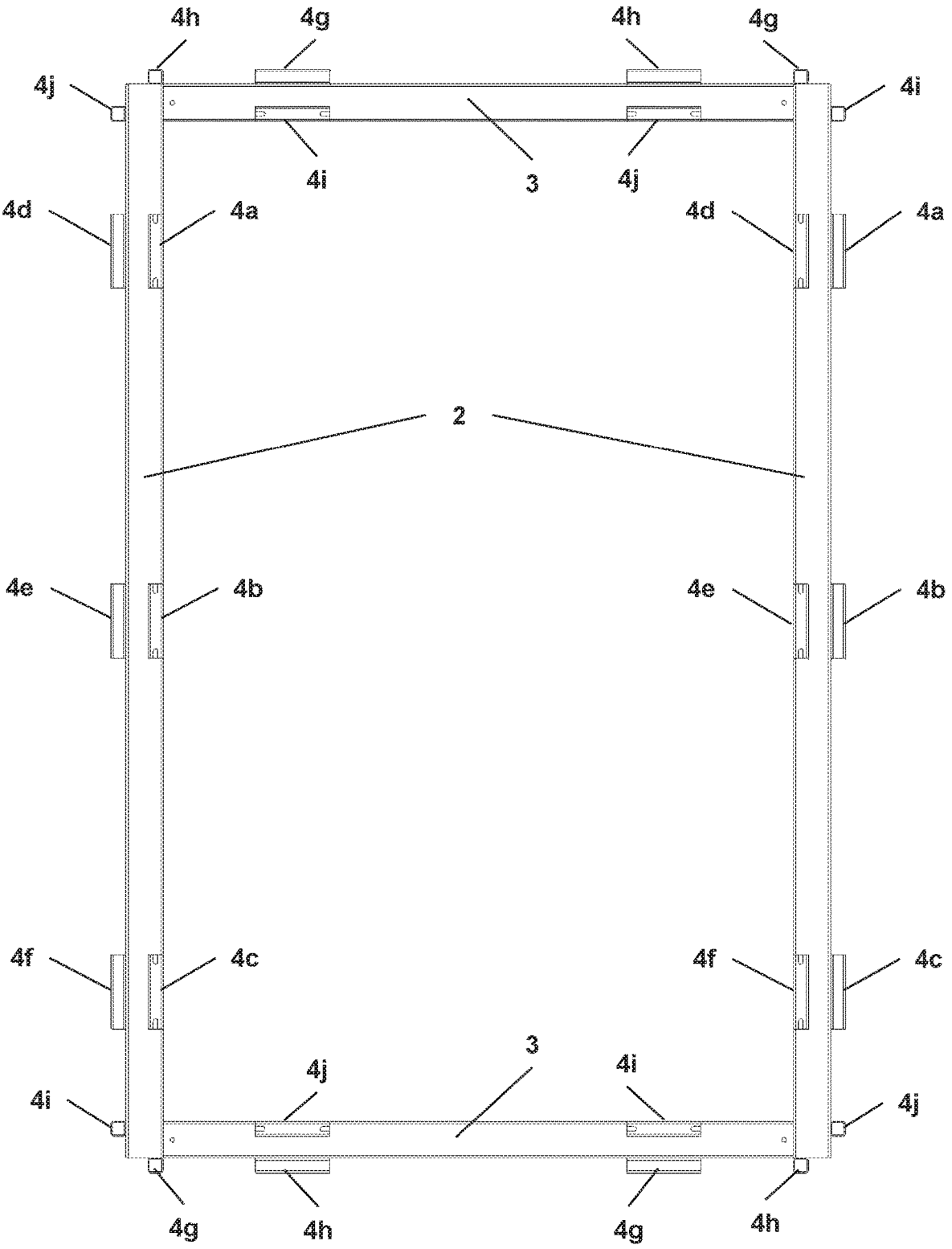
FIG. 2*a* shows a side view of the framework module of FIG. 1.
Figure 2B:
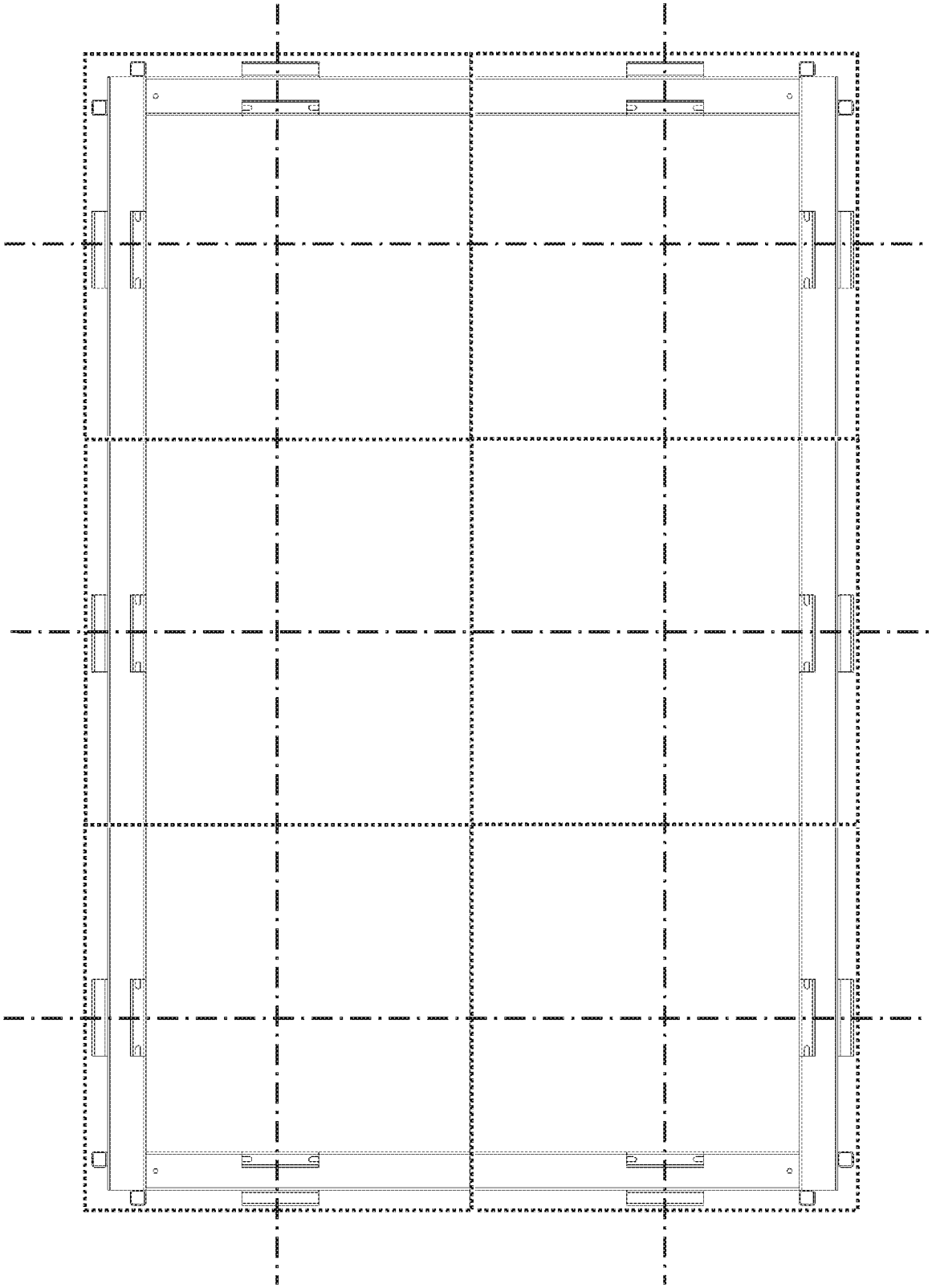
FIG. 2*b* shows the same view of the framework module as FIG. 2*a*, with dotted lines defining a 2×3 grid of 1 m squares superimposed on the framework module, the framework module locating within the 2×3 grid in use, and locating within a 2 m×2 m×3 m volume.
Figure 3:
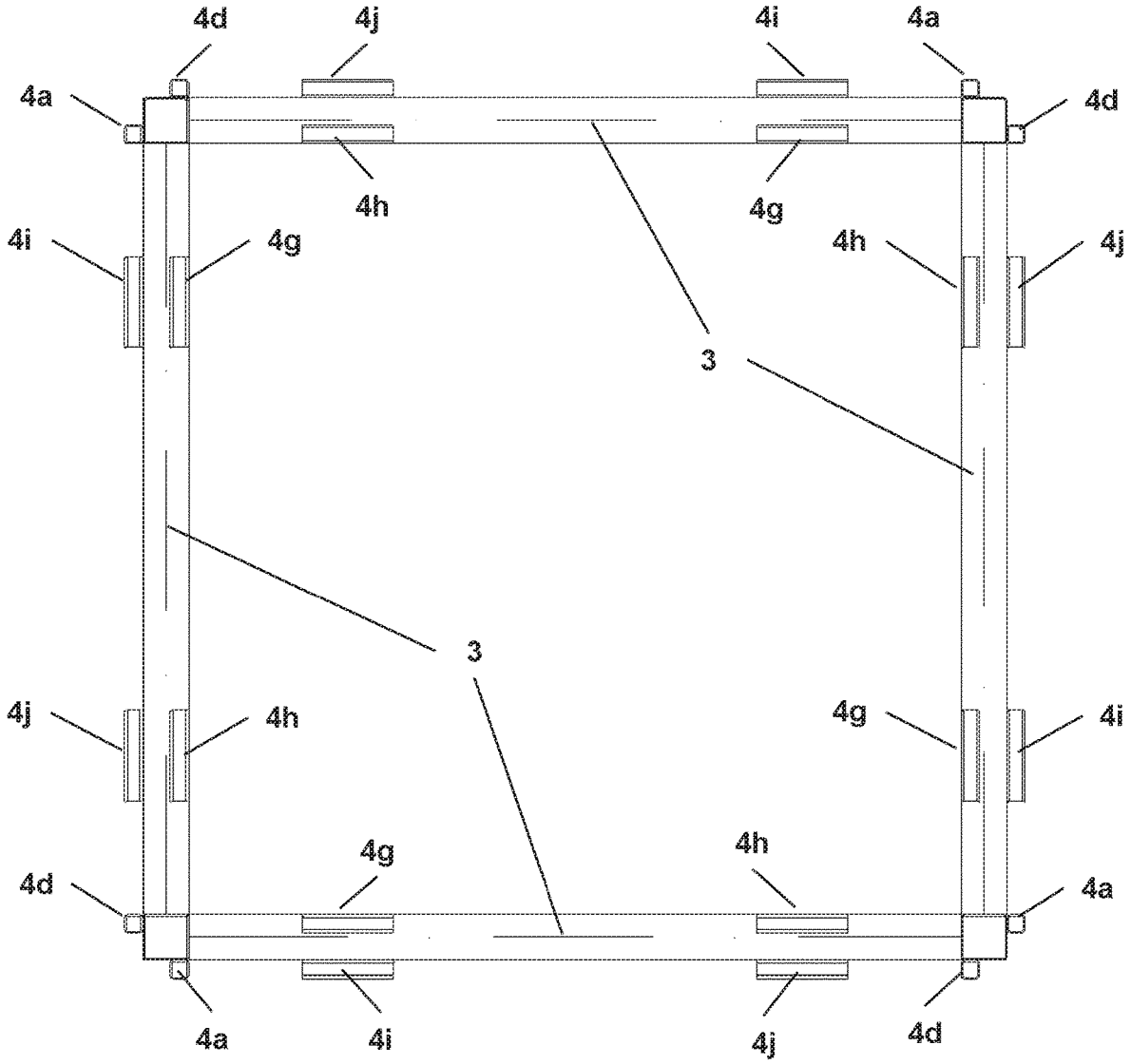
FIG. 3 shows a top or plan view of the framework module of FIGS. 1 and 2.

When all the beams are inter-connected, and the connection points are fixed to the beams, the framework module 1 has a volume of nearly 2 m×2 m×3 m. In use, each framework module is treated as having a volume of 2 m×2 m×3 m. 10 mm spacers are used on each side of each of the connection points to make up the gap between interconnected framework modules 1. As shown in FIG. 2*b*, viewed from the side the framework module 1 can be divided into a 2×3 grid of 1 m×1 m squares. The connection points always run halfway through the 1 m×1 m squares and are symmetrical around the 2 m×2 m×3 m volume.

The connection points 4 are formed so that they can be connected to connection points on an adjacently-located substantially identical framework module (either or both of above/below, and/or to the side), so that when a number of the framework modules 1 are connected together they form an open-web truss of vertically and horizontally aligned members.

The connection points 4 are connected to the beams 2, 3 as follows:

Three connection points 4*a*, 4*b*, 4*c* are attached to each of the upright beams 2, with a first connection point 4*b* substantially at the centre of the beam 2 (i.e. so that the mid-point of it's 200 mm length is at the mid-point of the beam 2—that is, 1.45 metres along the length of the beam 2), with the remaining two connection points 4*a*, 4*c* spaced so that their mid-points are one metre from the mid-point of the centrally located connection point 4*b*. That is, their inner ends are each 800 mm from the ends of the central connection point 4*b*, and their outer ends are each 350 mm from the ends of the beam 2.

Three further connection points 4*d*, 4*e*, 4*f* are attached on the other outwardly facing side of the upright beams 2 with the same spacing as 4*a*, 4*b*, 4*c*.

Two connection points 4*i*, 4*j* are attached to the side of each of the cross beams 3, in the same plane as the connection points 4*a*, 4*b*, 4*c* and spaced so that their mid-points are each 500 mm from the mid-point or mid-line of the cross beam 3. That is, the centres of the connection points 4*i*, 4*j* are one metre apart.

Two further connection points 4*g*, 4*h* are attached to the top of each of the upper cross beams 3 and bottom of lower cross beams 3 with the same spacing as the connection points 4*i*, 4*j*.

All connections points have a face adjacent to the inner edge of the outwardly facing sides of beam 2 and beam 3.

It can be seen that all the connection points along any one vertical or horizontal vector are spaced no more than 1 m apart (that is, the connection points on the cross-beams will be spaced 1 m apart from their closest neighbour on the same vector on a directly adjoining and connected framework module 1.

It can be seen that the framework module 1 and it's connection points 4 are configured to have both vertical and horizontal axes of symmetry through a 2 m×2 m×3 m box outside of the beams 2, 3.

In a second embodiment, and as shown in FIGS. 5 to 9, a framework module 101 very similar to that of the first embodiment is created by connecting upright beams 102 and cross beams 103 to form a framework module 101. The beams 102, 103 have substantially the same dimensions as for the first embodiment described above, and have connection points 104 attached to or formed on the upright and cross beams 102, 103, on the outwardly-facing surfaces, the connection points 104 substantially the same as, and in substantially the same positions on the beams 102, 103, as the connection points 4 described above. The framework module 101 has the overall shape and form of a rectangular box frame the same as for the framework module 1 described above, with open sides and open end faces, the uprights 102 and cross beams 103 rigidly connected at their ends in the manner described in detail below.

In this embodiment, the beams 102 and uprights 103 are bolted together at their ends using integral brackets 105*a*, 105*b* and bolts, as described below. The brackets 105 are shown alone in FIG. 7. The brackets 105 are equal-angle brackets, formed so that the final shape is two planar elements mutually connected along one longer edge so that the elements are perpendicular to one another, the edges opposite the connected edges forming two free edges. Each bracket has one face or planar element that has notches 106 formed in the upper and lower ends, on the centreline of the face. The other face has a pair of boltholes 107 formed on the centreline, slightly inwards of the notches 106 on the other of the faces. The notches 106 and boltholes 107 are sized for fitting a bolt (i.e. the shaft will just pass through, but not the head or nut).

Figure 5A:
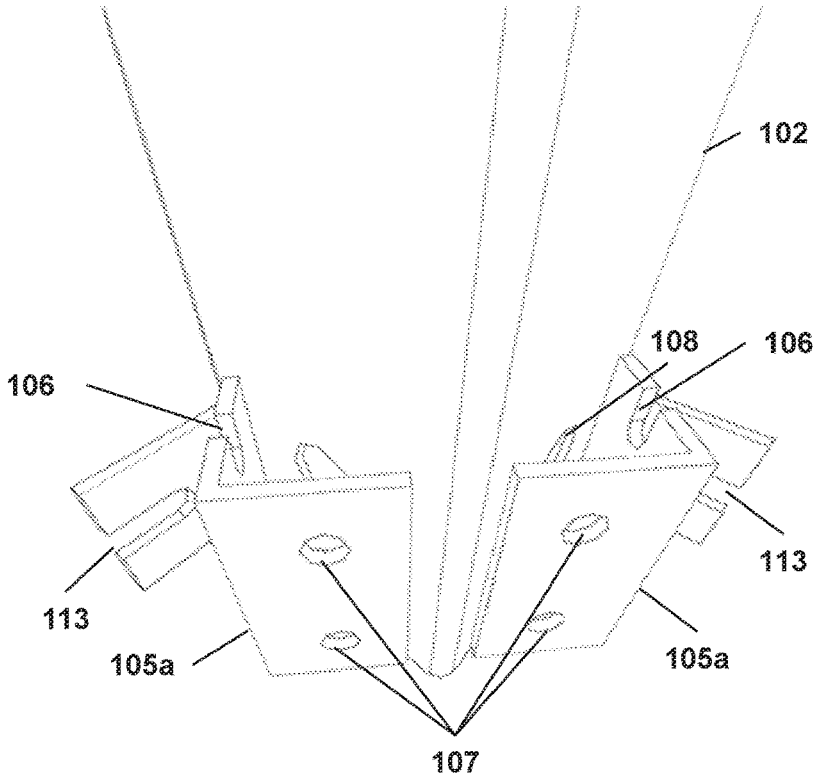
Figure 5B:
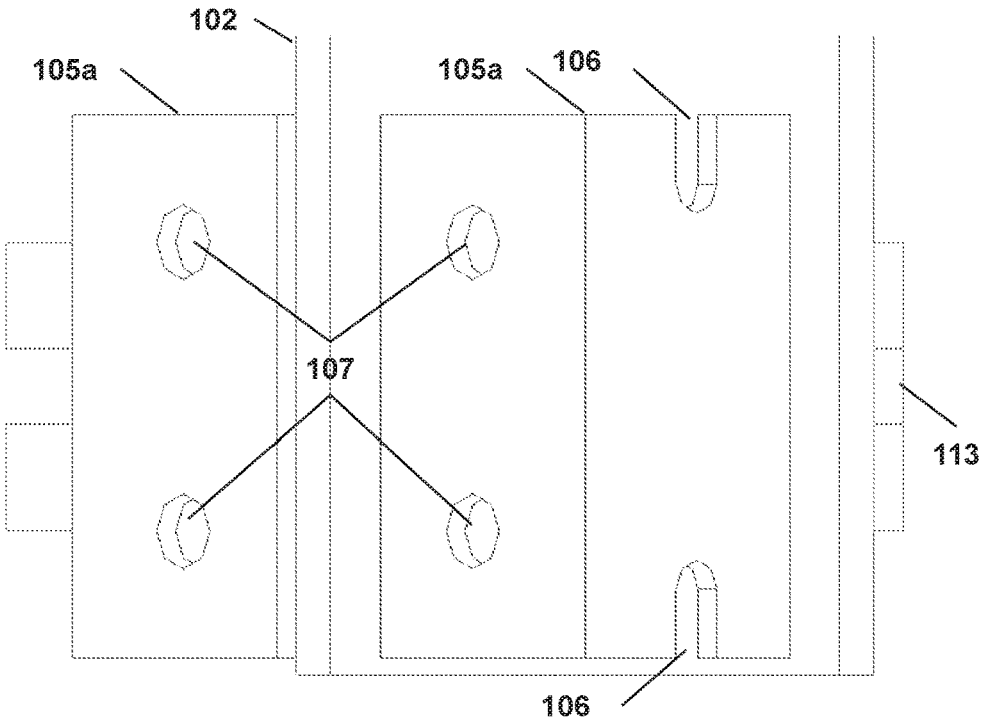
FIG. 5*b* shows a side view of the end of the upright shown in FIG. 5*a*.
Figure 5C:
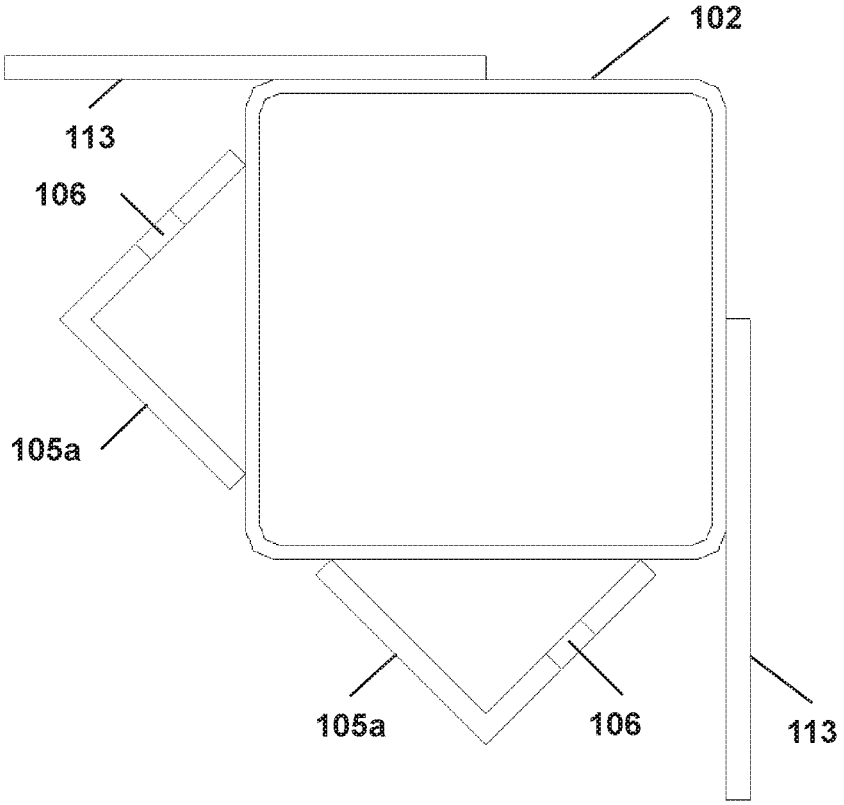
FIG. 5*c* shows a top view of the end of the upright of FIGS. 5*a* and 5*b*.
Figure 6A:
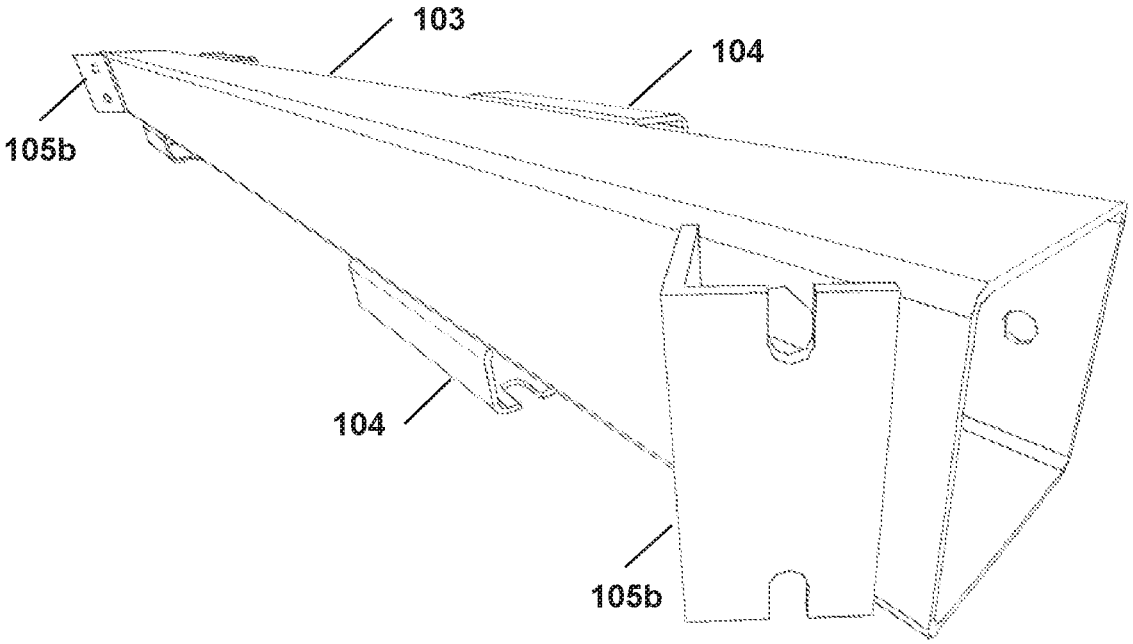
FIG. 6*a* shows a perspective view from the end and to one side of a horizontal beam according to a second embodiment of the invention, the beam having a single right-angle bracket connected at each end on the same face, the brackets aligned perpendicular to the axis of the beam, the brackets having notches at each end on their outer faces, and a pair of bolt holes on their inner faces, the beam having equivalent bolt holes formed through its face inside the perimeter of the bracket, so that the shaft of a bolt and nut can pass through a bolt hole in the beam and the bracket.
Figure 6B:
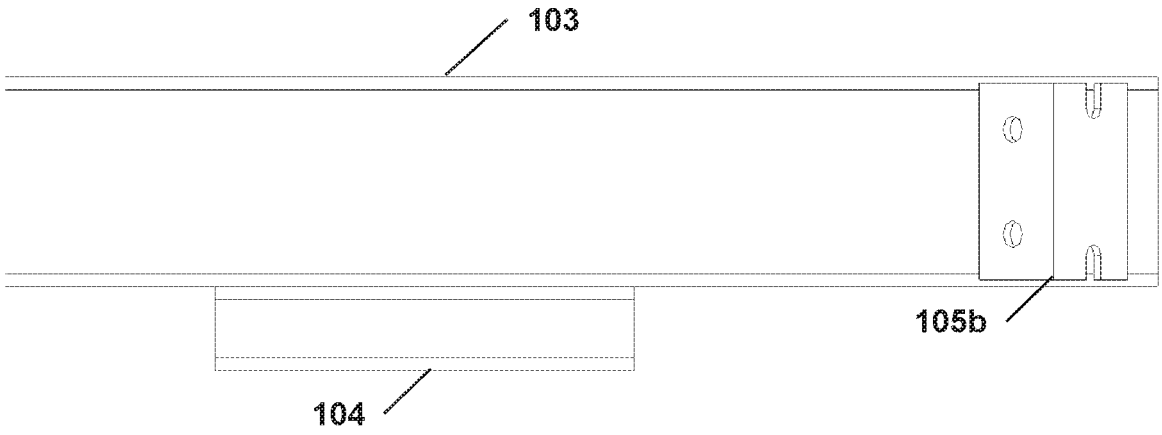
FIG. 6*b* shows a side view of the end of the beam of FIG. 6*a*.
Figure 6C:
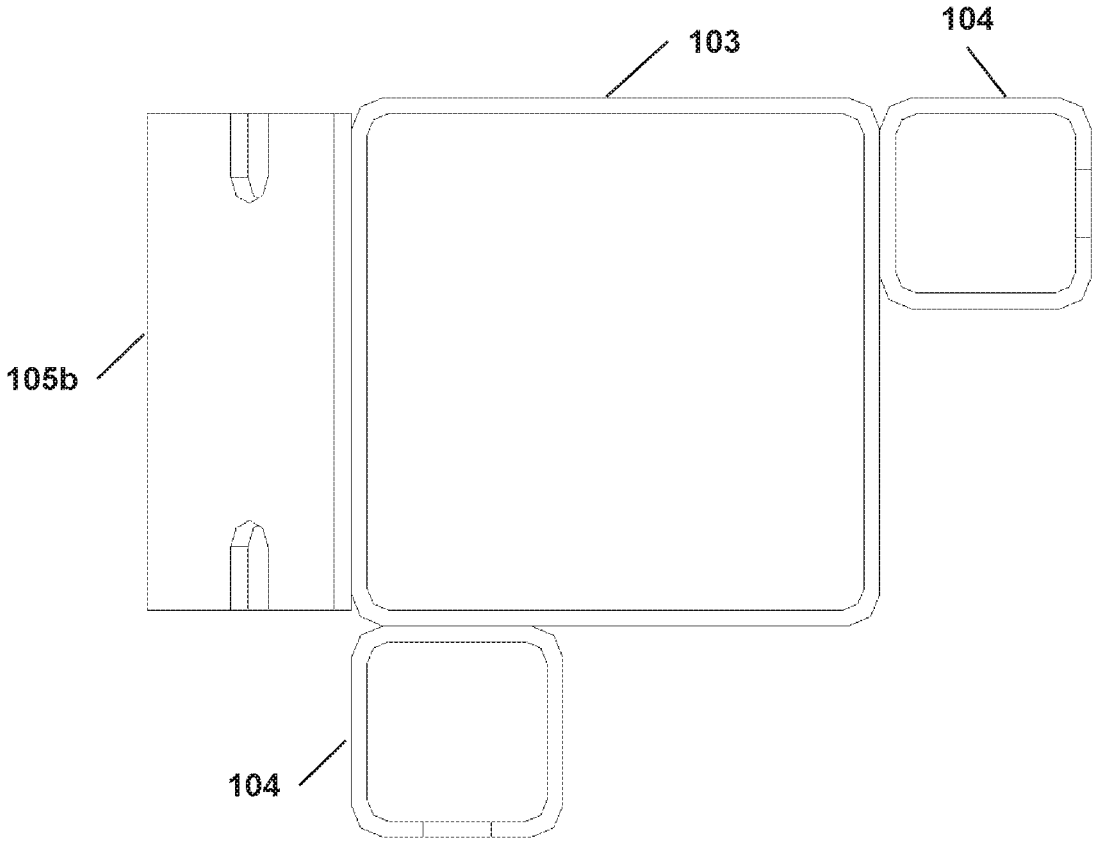
FIG. 6*c* shows and end view of the end of the beam of FIGS. 6*a* and 6*b*.
Figure 6D:
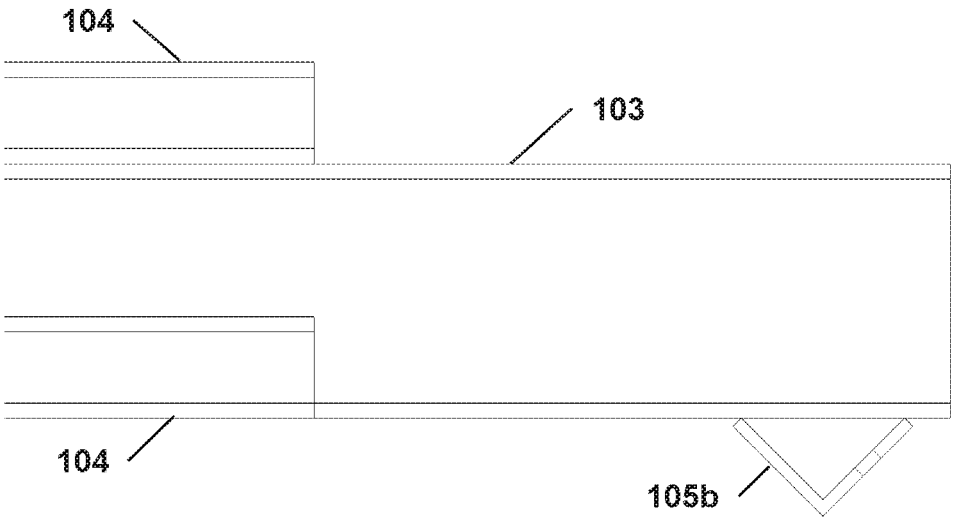
FIG. 6*d* shows a top view of the end of the beam of FIGS. 6*a* to 6*c*.
Figure 6E:
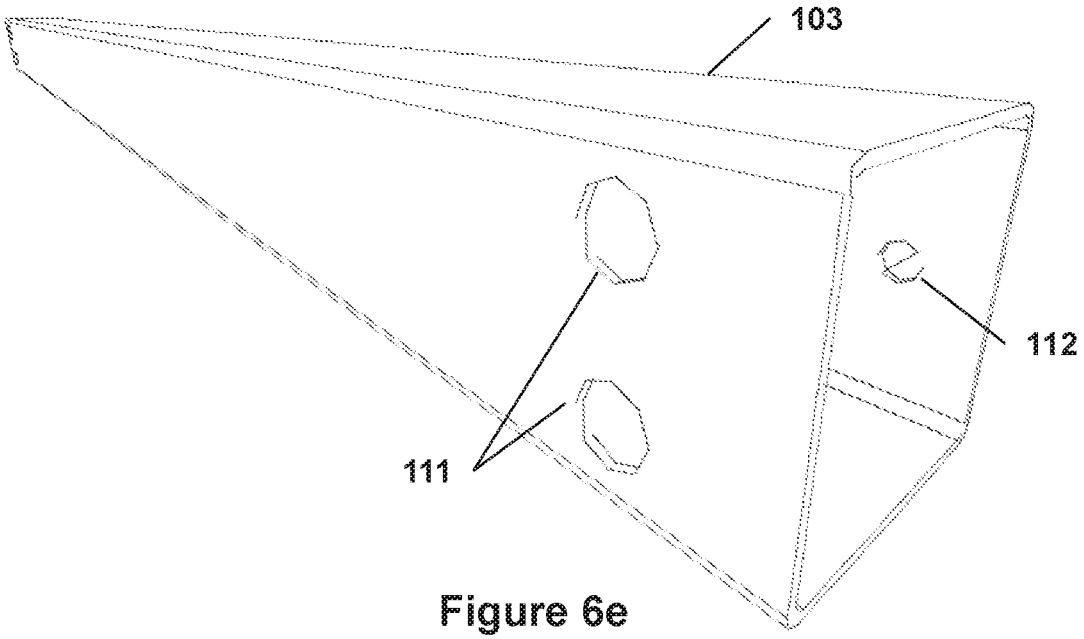
FIG. 6*e* shows a perspective view from the end and to one side of the beam of FIGS. 6*a* to 6*d*, without the bracket present, to show the bolt holes in the beam.
Figure 7:
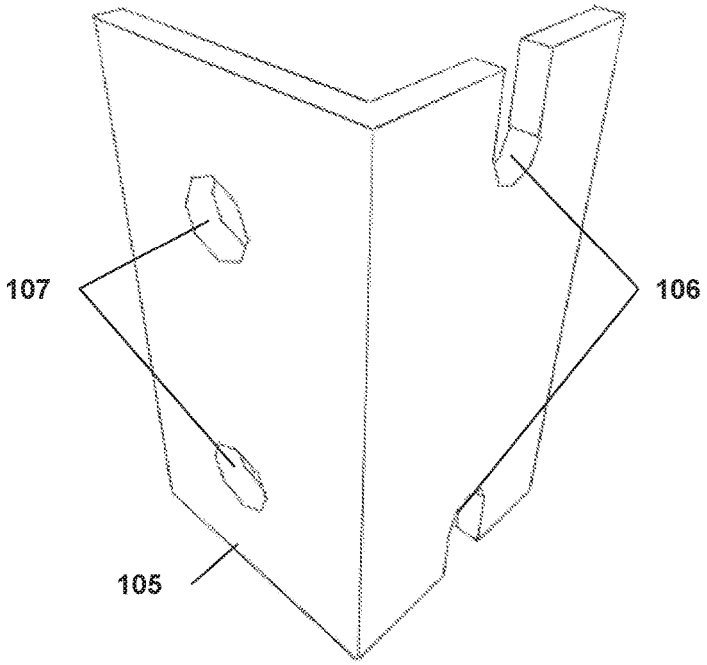
FIG. 7 shows a perspective view from the front and slightly above of the bracket that is connected to the horizontal beams and uprights of FIGS. 5*a* to 6*d*, showing the notches and bolt holes in the faces of the bracket.

As shown in FIGS. 5*a*-5*c*, the members that are aligned vertically in use—uprights 102—have two brackets 105*a* welded to two adjacent external faces at or close to the end, at each end (four brackets in total on each upright 102). The pairs of brackets 105*a* at each end are connected to the same faces as the pair of brackets at the other end. The free edges are welded to the outer surface of the upright so that the right-angle corner where the two planar sides meet is outermost, and so that this corner is substantially aligned with the centreline running along the centre of the upright 103 from bottom to top. As shown in FIGS. 5*a*-5*c*, the notches 106 face outwards. That is, adjacent faces of the neighbouring brackets 105*a* at one end have the notches 106 formed in their upper and lower ends, and the boltholes 107 are on the inward-facing faces. The upright 102 has larger apertures 108 formed through its end faces, in the same faces as those which the brackets 105 are connected to, these formed within or inside the area covered by the brackets 105. As outlined above, the notches 106 and boltholes 107 are sized for fitting a bolt. The larger apertures 108 are sized and shaped to just allow passage of the head of a bolt whose shaft will fit the boltholes 107.

As shown in FIGS. 6*a*-6*d*, the members that are aligned horizontally in use—beams 103—have two brackets 105*b* welded one at each end (two brackets in total on each beam 103). The pairs of brackets 105*b* at each end are connected to the same face. The brackets 105*b* are the same shape and size as the brackets 105*a*, and are connected by welding their free edges to the outer surface of the beam in a similar manner to that described above. However, the brackets 105*b* are aligned so that the outer corner is perpendicular to the axis of the beam—i.e. it will be vertically aligned in use once the frame 101 is assembled. The bracket 105*b* is aligned so that the notches 106 face towards the closer end, and the boltholes 107 face towards the far end. A pair of bolt apertures 111 are formed in the face of the beam 102 under the bracket 105*b*, in line with the outer corner of the bracket 105*b*. These are sized to allow the shaft and nut to pass through. A single bolt hole 112 is formed on the opposite face to these, on the centreline.

The brackets 105 have a length/height so that they will just slide into the open ends of the beams 103.

Figure 8:
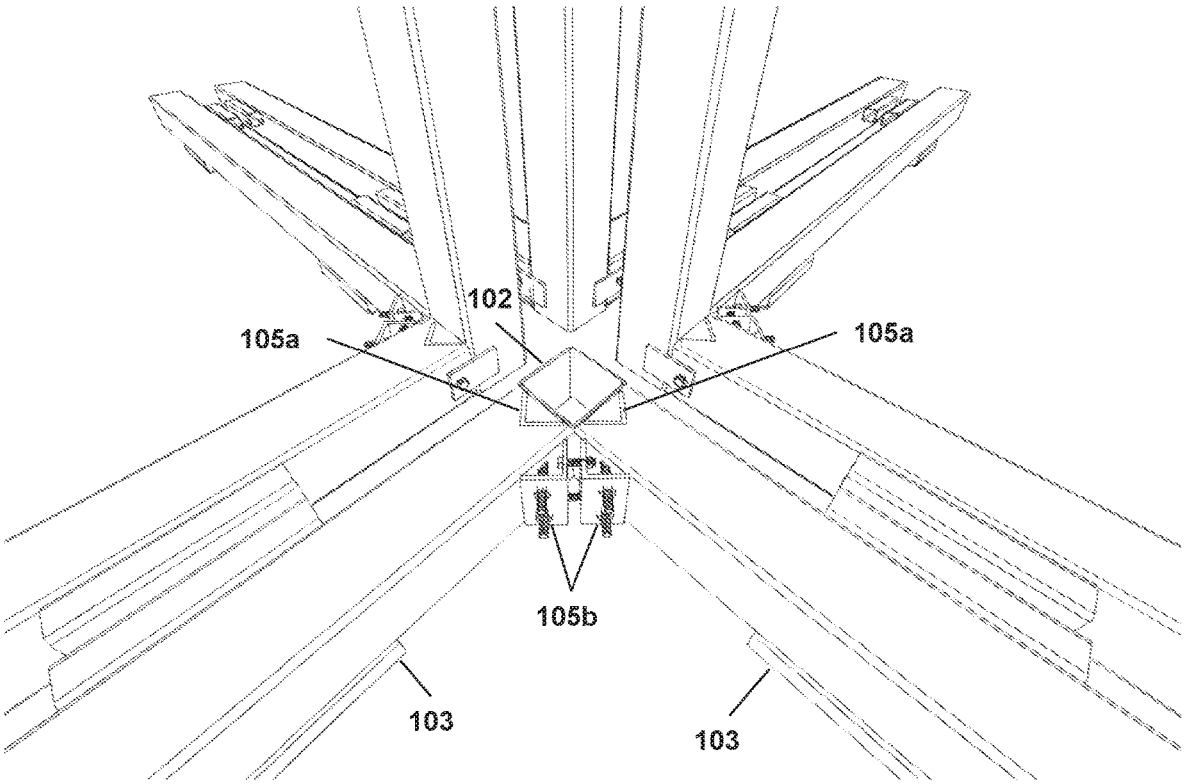
FIG. 8 shows a hidden detail view of a pair of horizontal beams connected to an upright in use, showing detail of the position of the brackets and the connecting bolts between the uprights and the horizontal beams.
Figure 9:
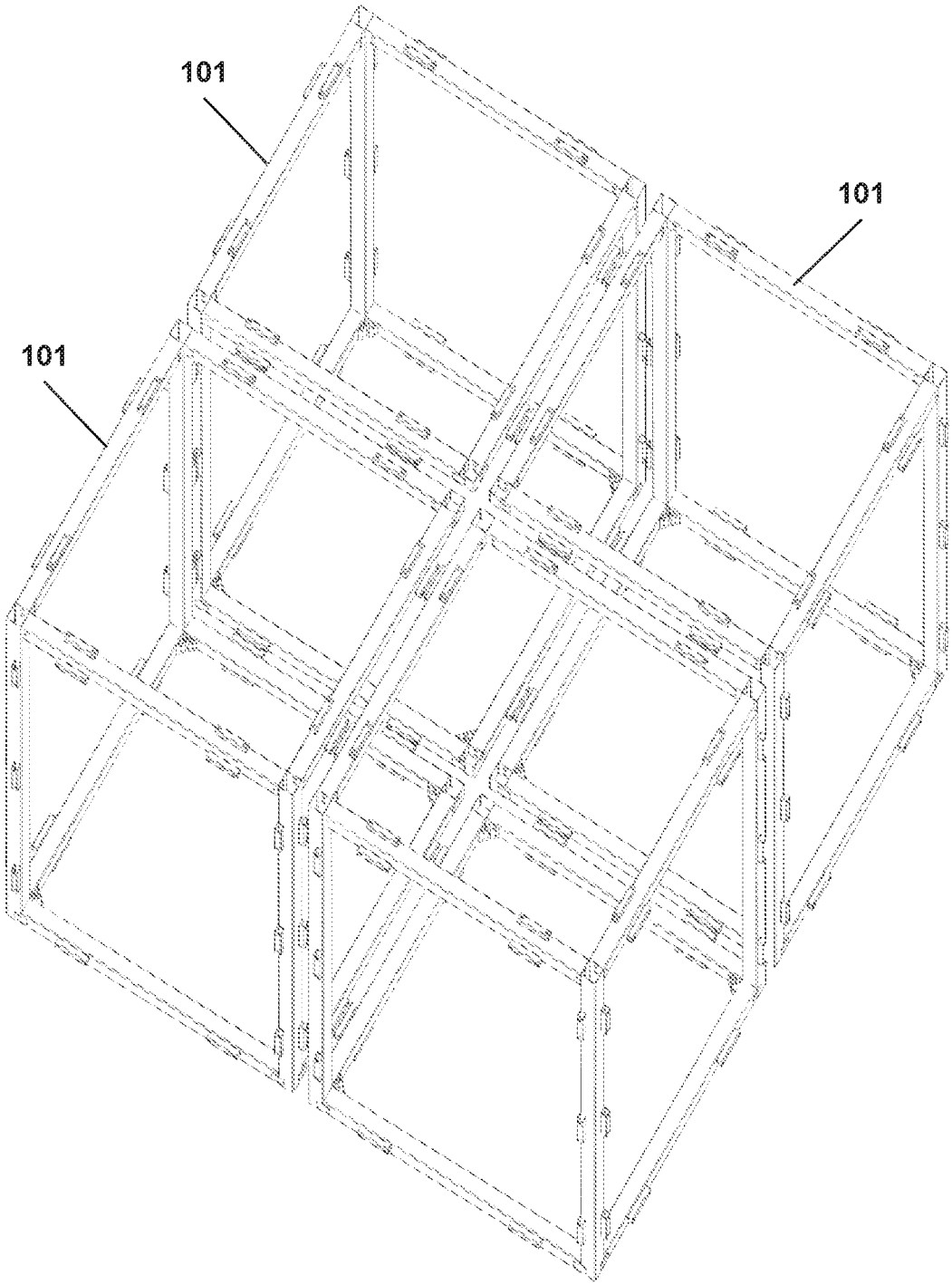
FIG. 9 shows a perspective view from above and to one side of a framework module according to a second embodiment of the invention, showing detail of the elongate upright and cross beams that form the framework module, and which are connected at their ends via brackets to form a box frame with open side and end faces, the figure also showing connection points located on each of the upright beams that allow mutual connection with equivalent connection points located on a substantially identical adjacent framework module.

In use, as shown in FIG. 8, the ends of two beams 103 are connected to the end of an upright 102 by sliding the open ends onto two adjacent brackets 105*a* on the end of the upright 102. Bolts are passed outwards from the inside of the upright 102, so that the shafts pass through the apertures 107 on bracket 105*a*, through the bolt apertures 111, and then through the boltholes 107 on bracket 105*b*. These bolts are then tensioned via two nuts. Tensioning these two bolts creates the connection force between the horizontal and vertical members 103, 102, the force acting at an angle of 45 degrees to the face of the upright 102. Two further bolts can be inserted into the notches 106, which face each other on the inside of the corner between the two horizontal beams 103 and brackets 105*b*, to connect the two adjacent horizontal member brackets 105*b*.

A metal reinforcing tab 113 is connected on the outer face of each vertical member via the single bolt hole 112. The tab 113 prevents the beam 103 from sliding out of alignment with the upright 102 due to the tension at 45 degrees and provides additional vertical load support for the upright 102.

As well as allowing the required rigid connection between members, this type of connection also allows adjustment of the connection between members, to ensure the connections are at the required angle—e.g. perpendicular. Members can be removed after assembly of multiple adjacent frames, stacked more effectively for transport, and assembled without the use of heavy machinery. The uprights 102 can be adjusted into perpendicular by adjusting the two nuts at the outer end of each of the four bolts connecting the upright 102 to the two beams 103. Similarly the two beams 103 can be adjusted through the bolted connections between their brackets 105*b*.

The bolting design enables uprights 102 to be removed by sliding away from the beams 103 at an angle of 135 degrees even after adjacent frames have been installed. This capability facilitates a unique build method where rooms are formed or changed after the structure has been put in place by adding and removal of uprights 102 within the frames 101. All connection bracket welding and bolting connections occur on the outside of the uprights 102. This preserves the vertical conduit. Leaving this space free of interference, allowing it to be used as a conduit for running utility cables and pipe work after the frames are in place and insertion of piles. Bolted connections allow pre-fabricated parts to be more efficiently transported to site and parts can be assembled without the use of heavy lifting equipment.

As shown in the figures for the second embodiment, the connection points 104 are substantially the same as those for the first embodiment, but have notched or slotted outer ends. It should be noted that notched or non-notched connection points could be used for either embodiment, although the notches or slots facilitate joining or connection via bolts or similar slipped into adjacent pairs of notches.

As noted above, in use a number of the framework modules 1 or 101 are connected together to form an open-web truss of vertically and horizontally aligned members, which is used to form a skeleton framework for a building.

Rooms are configured by removing one or more uprights from the frame before or after construction and installation. The symmetry and geometry of the frame design of the framework module and connection points enable the use of a single exterior wall, floor and roof panels design that creates a continuous outer shell. The design of the framework module preserves vertical conduits (within the upright beams) within which utility pipe work and electrical cabling can be run and located. These vertical conduits are maintained continuously throughout the entire structure, through the upright beams in each framework module. Because the connection points are not at the corners, utility pipe work and cabling can be run through these vertical conduits and then distributed laterally within the floor and roof cavities between vertical stacked framework modules.

Using this construction method, structural stiffness is achieved when one framework module is connected to an adjacent framework module, which effectively makes a rectangular truss between any two connection points through the frame members. Connection points on the building outer sides can be used to mount exterior panels of single design for wall, roof and under floor. When a number of framework modules are mounted together, the connection points are always 1000 mm apart along the axis of either beam or beam.

It can be seen that mounting locations are consistent and symmetrical around the structure of the skeleton frame created by connecting a number of the framework modules 1 together. Therefore, exterior panels of a single design can be used for the building's outer floors, roof and walls. Regardless of which connection points are used, exterior panels mount in a manner which is symmetrical through the planes making up the 2 m×2 m×3 m volume. This allows panels to be mounted to any configuration of framework modules 1 and creates an outer building shell that can be sealed using typical builders silicon around any inward or outward framework module corner as well as any flat walls. Avoiding air leakage greatly improves any building's energy efficiency.

When used to create a skeleton structure for a building, the framework module is a repeating structure. This creates fabrication economies of scale. Furthermore, frames internal to the outer shell need not be painted or surface treated because moisture levels inside the shell can be controlled. A tower created by stacking framework modules vertically could be used for the remaining lifting and materials handling, which avoids the need for the use of a full time crane, which is required with most modular constructions. After completion of the required lifting, the tower can be incorporated into the building.

Building foundations can be created from the top part of a framework module. The uprights or upright beams are cut to lengths that will accommodate local topography. These foundation framework modules are supported on piles and their height can be adjusted using jacking screws after the pile has been set/grouted in place. Such a system allows piles to be statically loaded for testing and if further settling occurs, further adjustment can take place or at any time during the buildings use. If more adjustment is required than the existing pile length can accommodate, additional spliced pile length to further lift the foundation frame can be fed down through the upright beams which form vertical conduits.

When drilling piles, a foundation framework module 1 can be used to mount core drilling equipment which provides the required torsional stiffness (opposing core drill torque) and avoids the need for large/heavy drilling machinery. Because cores are drilled through the vertical conduits of the framework modules, pile location inaccuracies are avoided.

The invention claimed is:

1. A framework member for use in modular building construction, comprising:

an elongate beam formed from a hollow tube with a substantially square or rectangular cross section;

a mutual connection means at or towards at least one end and on at least one face of the elongate beam, configured to allow connection of the elongate beam to a separate and similar elongate beam so that the beams extend perpendicular to one another once connected, the connection means comprising:

a pair of right-angle brackets connected to the elongate beam at or close to the end of the elongate beam and configured to fit within and slide into an open end of the separate and similar elongate beam to allow connection, wherein a pair of the brackets are connected to the same face of the elongate beam at opposed ends of the beam, the brackets being aligned perpendicular to the axis of the beam;

at least one connection point on an outer surface of the elongate beam partway along the axis of the elongate beam, wherein each connection point is formed from a length of tube connected to an outwardly-facing portion of the beam;

wherein each bracket of the pair of right-angle brackets is aligned in parallel with the axis of the elongate beam and comprises a plurality of bolt holes defined in the face of the bracket aligned towards the separate and similar elongate beam to allow connection.

2. A framework member as claimed in claim 1 further comprising another pair of brackets aligned in parallel with the axis of the beam at another end of the beam.

3. A framework member as claimed in claim 1 having an overall length of substantially 2.9 metres.

4. A framework member as claimed in claim 1 wherein each of the brackets comprises a plurality of bolt holes passing through the face of the bracket aligned towards the other one of the pair at the opposite end of the beam.

5. A framework member as claimed in claim 1 wherein each one of the brackets further comprises a pair of notches at each end of another face of bracket.

6. A framework member as claimed in claim 1 wherein the beam has a length of substantially 1.7 metres.

7. A framework member as claimed in claim 1 wherein each connection point is connected in parallel with the axis of the beam.

8. A framework member as claimed in claim 1 wherein each of the connection points has a length of substantially 200 mm.

9. A framework member as claimed in claim 1 wherein each connection point is located towards an edge of the beam.

10. A framework member as claimed in claim 1 wherein the framework member is arranged to connect to a similar member with a rotational symmetry in a manner such that the connection points and brackets do not interfere with connection in any rotational orientation.

11. A framework module for use in modular building construction, the framework module comprising a plurality of framework members in accordance with claim 1, the framework members being rigidly connected at or towards their ends to form a box frame with open side and end faces.

12. A building, comprising a plurality of framework modules as claimed in claim 11.

13. A method of constructing a building using a plurality of framework modules as claimed in claim 11, comprising the steps of:

(i) emplacing the framework modules next to and on top of one another as required in order to form an open-web truss of vertically and horizontally aligned members, and so that connection points on adjacent framework modules are directly adjacent;

(ii) connecting the framework modules to one another via the directly adjacent connection points;

(iii) removing vertical members before or after construction to create spaces within the building.

14. A framework module as claimed in claim 11 wherein the framework members are configured to allow mutual connection with other framework members located on a substantially identical adjacent framework module so that a plurality of framework modules can be connected together to form an open-web truss of vertically and horizontally aligned framework members.

15. A framework module as claimed in claim 11 wherein box frame and connection points are configured to have both vertical and horizontal axes of symmetry around the external planes of a box defined by a 2 meter by 2 meter by 3 meter volume within which the framework module is located.

* * * * *